United States Patent [19]

Lauchenauer

[11] Patent Number: 4,735,854

[45] Date of Patent: Apr. 5, 1988

[54] POLYMERIC ARTICLE FOR TRANSFER TO A SUBSTRATE

[75] Inventor: Alfred E. Lauchenauer, Horn, Switzerland

[73] Assignee: Jacob Schlaepfer & Co., A.G., St. Gallen, Switzerland

[21] Appl. No.: 580,751

[22] Filed: Feb. 15, 1984

Related U.S. Application Data

[63] Continuation of Ser. No. 359,719, filed as PCT EP81/00095 on Jul. 10, 1981, published as WO82/00307 on Feb. 4, 1982.

[30] Foreign Application Priority Data

Jul. 10, 1980 [GB] United Kingdom ..... 8022653
Nov. 10, 1980 [GB] United Kingdom ..... 8036013

[51] Int. Cl.[4] ..... B32B 3/00; B32B 7/10; B44C 1/16

[52] U.S. Cl. ..... 428/347; 428/914; 156/230; 156/289

[58] Field of Search ..... 156/230, 231, 238, 240, 156/241, 247, 249, 289, 235; 428/40, 42, 200, 202, 345, 355, 349, 352, 914, 305.5, 317.1, 347

[56] References Cited

U.S. PATENT DOCUMENTS

| | | | |
|---|---|---|---|
| 2,559,649 | 7/1951 | Little et al. | 156/238 |
| 2,644,262 | 7/1953 | Schoenberg et al. | 156/234 |
| 3,523,846 | 8/1970 | Muller | 156/231 |
| 4,151,319 | 4/1979 | Sackoff | 156/249 |
| 4,171,398 | 10/1979 | Hunt | 156/234 |
| 4,219,596 | 8/1980 | Takemoto et al. | 156/238 |
| 4,275,106 | 6/1981 | Watanabe | 428/202 |
| 4,322,461 | 3/1982 | Raphael et al. | 156/235 |
| 4,326,005 | 4/1982 | Reed et al. | 428/914 |
| 4,388,137 | 6/1983 | McCarty et al. | 156/231 |

FOREIGN PATENT DOCUMENTS

| | | | |
|---|---|---|---|
| 1215914 | 12/1970 | United Kingdom | 156/230 |
| 1469955 | 4/1977 | United Kingdom | 156/230 |
| 2090193 | 7/1982 | United Kingdom | 156/236 |

*Primary Examiner*—Donald E. Czaja
*Assistant Examiner*—Louis Falasco
*Attorney, Agent, or Firm*—Edwin E. Greigg

[57] ABSTRACT

The invention relates to a method of applying polymeric materials to the surface of a substrate by providing a layer of polymeric material on a release sheet and then subsequently transferring the polymeric material from the release sheet by the application of heat and pressure sufficient to effect adhesion of the polymeric material to the substrate and thereafter peeling the release sheet from the polymeric material. The invention is particularly concerned with the application of polymeric materials being capable of a secondary reaction at the time of application to the substrate or subsequent thereto.

7 Claims, No Drawings

POLYMERIC ARTICLE FOR TRANSFER TO A SUBSTRATE

This is a continuation of copending application Ser. No. 359,719 filed as PCT EP81/00095 on Jul. 10, 1981, published as WO82/00307 on Feb. 4, 1982 now abandoned.

DESCRIPTION

This invention relates to the application of polymeric materials to substrates. Numerous methods are available for the transfer of polymeric materials to the surface of sheet materials by a variety of methods either all over or locally in a pattern to produce decorative or physical effects. The wide scope of known application methods provides solutions for a wide range of problems, but they are not suitable, in general, for the application of patterns in register to cut parts of sheet materials. It is particularly difficult to apply patterns of polymeric material to precut parts locally in an accurately registered pattern with respect to various parameters on the cut parts themselves.

Printing processes hitherto involving paste or solutions are unsuitable due to the fact that any continuous or semi-continuous printing process requires expensive control apparatus and expensive means for the positioning of the materials to be printed in register with the means for applying a pattern.

In contra-distinction to the continuous printing of sheet material if a printing stencil is employed, it has to be changed if the size or shape of a pre-cut part changes, but still the difficulty of locating the cut part with great accuracy is necessary.

Furthermore, if the thickness of the cut part is variable, then another variable parameter needs to be taken into account during the printing operation and this additionally increases the cost of the equivalent.

Such conventional printing processes present additional problems in the drying step after the application of the paste or solution. Care has to be taken that the flow of air necessary to remove solvent vapours of water is kept low or is directed against the surface of the printed parts instead of parallel to their surface in order to prevent uncontrolled lifting or curling.

Control of the penetration of a paste or solution into the structure of the precut material is another serious problem.

According to the present invention there is provided a method of applying a polymeric material to the surface of a substrate which polymeric materials is pressure sensitive or which may be rendered pressure sensitive by the action of heat, which method comprises (i) applying at least locally a layer of said polymeric material to a sheet material capable of acting as a release sheet;

(ii) contacting the said polymeric material with the surface of the substrate to which the said polymeric materials is to be applied;

(iii) applying heat and pressure sufficient to effect adhesion of said polymeric material to said substrate; and (iv) peeling the release sheet from said polymeric material.

The release sheet is selected such that the peel strength defined as the force required to separate a strip 5 cm wide from the release sheet is at least 10% preferably at least 25% lower than tensile strength of a 5 cm width of the same polymeric material 0.2 mm thick.

For the purposes of the present invention, the term "pressure sensitive" means that a material when pressed against a substrate will adhere to the surface of this substrate. This pressure sensitivity may be inherent to the plymeric material itself, it may be induced by additives or—in the preferred mode of application—the polymeric material itself, or additives may be rendered pressure sensitive when heated to what is called the "tackifying temperature" hereafter (a definition of this term is given below). This does not mean that the polymeric material per se or under the influence of additives present in the preparation has to be truly thermoplastic, i.e. that it must have more or less sharp melting point, at which it becomes liquid, solidifying again upon cooling, and showing the same melting point again when reheated. While preparations containing or consisting of truly thermoplastic polymeric material are useful in many cases, in others it is advantageous to use polymeric material as one of the components of a preparation, which exhibits a thermoplastic behaviour only in the sense that heat will merely lower intermolecular cohesion of the polymer, thereby becoming plastified, i.e. capable of getting embedded in microscopic or macroscopic surface features of a substrate having a porous, craggy or otherwise structured surface, and thus becoming durably anchored to this substrate when cooled. Since the release sheet as outlined below has a smooth, unstructured and essentially non-porous surface, the adhesion of the polymeric material to the release sheet is much less effected by the plastifying effect of the heat, and release of the polymeric material to the substrate thus is effected when the release sheet is peeled off.

The tackifying temperature of the polymeric material thus may be defined as being the temperature to which this material must be heated when together with the release sheet it is pressed against the substrate at a pressure of 1 kilo/square meter for 30 seconds to achieve after cooling an adhesion to the subtrate which is substantially higher than the adhesion to the release sheet, preferably at least twice as high.

The said polymeric material may include a reactant capable of initiating a reaction to change the characteristics of said polymeric material during or after the application of said heat and pressure. The layer of polymeric material may comprise two or more layers capable of chemical or physico-chemical interaction subsequent to application to the substrate. The initiation of the reaction or interaction between said layers may occur at a temperature greater than that of which adhesion of the material to said substrate takes place.

In a further embodiment of the present invention a reactant may be incorporated in the polymeric material layer in an encapsulated form for subsequent release.

Polymers suitable alone or as components of a preparation are for instance polyacrylic esters, polyvinyl acetate or other esters of polyvinyl alcohol, polymerisates and copolymerisates of acrylic monomers such as styrene, butadiene or other unsaturated hydrocarbons, of halogenerated acrylic or vinylic monomers with or without functional groups other than carbon-carbon double bonds.

Particularly suitable for many applications are polymers capable of undergoing reactions which increase intermolecular cohesion when heat is applied, examples being crosslinking reactions, the formation of a matrix within a polymer or transitions from a lower to a higher degree of polymerisation. A particularly suitable composition is one whose melt index (determined according to conventional methods) will drop by at least 25 percent, preferably at least 50 percent, when the essentially dry preparation is heated to a temperature 10° to 100° C. higher than the tackifying temperature for not more than two minutes.

The preparation may contain in addition to the polymeric material (which itself may consist of different components) known agents such as softeners, plastifiers, tackifiers, hydrophobing agents, flame retardants, blowing agents, thickeners, crosslinking catalysts, colouring material and antistatic agents. As mentioned above, polymers which are not truly thermoplastic in the sense that they can be reversibly liquified by heating to a certain temperature are quite suitable. In certain cases, particularly if either for the transfer or in the final product, fusible adhesive properties (a property inherent to truly thermoplastic material) are desirable, fusibles such as polythylene, polypropylene, polyamides (in particular in the form of low melting polymide mixtures such as terpolymers), polyesters or other thermoplastic polymers having a melting point in the range of 70° to 180° C. may be added, for instance in the form of fine powders. These powders may be incorporated into the preparation before it is applied to the release sheet, or they may be applied to either surface of the preparation when it is already on the transfer sheet.

Adding blowing agents to the preparation has also been found very useful for many applications. In selecting such an agent, the blowing temperature (i.e. the temperature at which gas or vapours are given off) is a very important criterium. This temperature should be such that it is higher than any temperature occurring during the application to the transfer sheet unless blowing, i.e. a conversion into a sponge structure is desirable before the release process, and it should be such that blowing takes place when intermolecular cohesion of the polymeric material is lowered by heat during the release/transfer process, unless it is desirable to effect blowing only at a later stage. In this latter case the blowing temperature has to be considerably above the tackifying temperature, e.g. 50° to 100° C. higher.

The preparation, i.e. components of the polymeric material and the additives, should be selected in such a way that when it is on the release sheet material ready for release/transfer, its cohesion at least at the tackifying temperature is at least 10 percent, preferably at least 25 percent higher than its adhesion to the release sheet. This ratio may be simply determined for instance by applying the preparation in the form of a strip to the release sheet, and then peeling the material from the release sheet. If it can be peeled off without being torn, cohesion is at least as high as adhesion at the testing temperature. To get a more quantitative result, the force necessary to peel the strip from the release sheet and the tensile strength of the strip (after it has been peeled) may be determined.

The release sheet is preferably selected in such a way that (1) at least the surface to which the preparation is applied is unstructured, sufficiently smooth and nonporous to minimize the influence of heating to the tackifying temperature on the peel strength. (2) It is virtually stable under the conditions under which the preparation is applied (as little swelling as possible if the preparation contains water or solvents) and under release transfer conditions (no appreciable effect of the heat applied). To avoid problems related to shrinkage in puckering creasing and curling. The release sheet thus should be stable at temperatures which are at least 30°, preferably 50° C. higher than the highest temperature occurring until release has been effected.

Paper, particularly paper coated with agents producing a smooth surface with low adhesion to other materials, has been found quite suitable, provided it provides adequate wetting properties toward the preparation and is dimensionally stable under application conditions. The same criteria apply to cellulose films.

Films consisting of thermoplastic polymers are suitable if they are dimensionally stable at the temperatures applied during application and release/transfer procedures and if the preparations used lend themselves to the application to hydrophobic surfaces.

Transparent, or translucent release sheets offer an advantage if they have to be cut into suitable shapes for the transfer to precut parts of substrates (e.g. to precut parts of garments etc.), because positioning is more simple.

The application of the preparation containing the polymeric material to the release sheet may be effected locally by any known printing method including spraying, screen or roller printing, or all-over by known procedures such as continuous all-over printing or casting. A very useful form of application in either case is the conversion of aqueous preparations into foams, which are applied to the release sheet as described above. If a more three-dimensional effect is desired, the preparation may be formulated in such a way that the foam or sponge structure is retained, i.e. still exists at least partly during and after the release/transfer process. Another method for producing three-dimensional, cellular structures on the substrate is to have blowing agent present in the formulation.

The amount of preparation applied to the release sheet is adjusted to the effects desired. If higher amounts per square centimeter are applied, i.e. if the local or all-over application has a higher thickness, a higher degree of stiffness will for instance result on the areas of the substrate to which transfer has taken place, and the same applies if the thickness of the transferred material is increased by imparting it to a cellular structure. If desired the thickness of the material may be varied over the area of the release sheet.

The release sheet usually is coated or printed in a continuous process while it is in the form of a sheet hundreds or thousands of meters long. After the polymeric material has been applied to it, water or other solvents are removed by drying, so that at the release/-transfer stage the polymeric material is in an essentially dry state.

The release sheet carrying the polymeric material may be cut into pieces before the release/transfer process, or it may remain in sheet form throughout the entire process.

Conditions during the release/transfer process will vary depending on the formulation used, the substrate to which transfer has to be made, the effects desired and the equipment used. Flat bed presses, hand irons (in the case of cut pieces), calender presses or other equipment capable of applying pressure of predeterminable magnitude in combination with heat at a predeterminable temperature may be used. Minimum pressures are usually around 100 to 300 grams per square centimeter, while the maximum may be 2 kilos per square meter or even more.

The pressing time will depend on the temperature gradient existing between the tackifying temperature and the surface temperature of the press, the thickness of the sheet materials interposed between the hot surface of the press and the material to be tackified, on the fastness properties desired, on the materials present etc. Minimum pressing times may be in the 5 to 15 second range, while maximum pressing times may be considerably higher, particularly if, for instance, crosslinking of the polymeric material or of components thereof is to be effected at the same time as transfer. Since pressing time usually will be kept low to achieve high manufacturing and equipment efficiency, heat treatments aiming at effects like crosslinking may be carried out subsequently, i.e. after the material has left the press.

If desired, pressure may be applied locally only, or it may be different for different areas, and the same applies to temperatures. In this way and/or by using press head surfaces which are not flat, but have lands alternating with recessed areas, it is even possible to effect transfer only locally, or vary the thickness of the transferred layer.

Transfer as mentioned above is effected by applying pressure to the temporary laminate when the polymeric material to be transferred has a temperature at least equal, preferably 25° to 100° C. higher than the tackifying temperature. In the case of reactive systems, i.e. of systems which under the influence of heat will change irreversibly their melt flow properties and/or their thermal behaviour generally, i.e. the tackifying temperature either by crosslinking (formation of a three-dimensional polymer or of a matrix inside the polymer, or by increasing the chainlength, by an increase of intermolecular forces acting between macromolecules or the evaporation or decomposition of agents lowering intermolecular cohesion) the heat treatment should be such that the melt Index (determined according to standard procedures) is reduced by at least 10 percent, preferably at least 50 percent. Another guide-line in the case of such reactive systems is to apply a heat treatment (during and/or after transfer) which—if applied to the reactive polymer system while it is still on the release sheet i.e. before contact with the substrate to which transfer has to be effected which will reduce the adhesion (peel strength) of the polymer system to the substrate by at least 50 percent compared to the adhesion the same polymer system has to the same substrate without such a previous heat treatment (the lowering of the peel strength is due to the lower degree of tackiness obtainable at the tackifying temperature if the material has been preheated to a temperature causing crosslinking or other irreversible changes).

In a further embodiment of the present invention the reusable carrier sheet such as films may be advantageous for economical reasons. "Reusable" means that the same carrier sheet is printed, dried and used for transfer several or many times, or even that it is used in the form of a continuous belt, which is printed with the polymer preparation, heated to effect drying or at least gelling of the polymer ("gelling" meaning that the preparation is no longer a liquid or paste having little cohesion, but a nonflowing jelly-like substance formed by coalescene of the colloidal or dispersed state in which the polymer was present when printed), and brought into contact with the sheet material to be printed, preferably at temperatures at least as high as the tackifying temperature, under sufficient pressure to effect transfer.

Such reusable carrier sheets may consist of films not affected by transfer temperatures and the compounds, in particular solvents present in the printing preparation, of coated fabrics, fibre-reinforced plastics or any other suitable material.

In particular, the use of a transparent hydrophobic film of such properties with an aqueous preparation will produce very interesting glossy transfer effects, i.e. that the transferred pattern shows a very high degree of gloss, which is durable to care treatments if the preparations are formulated suitably. In many cases, the gloss is greatest if transfer is effected by heat, but peeling off of the transfer sheet takes place only after the temperature of the transferred polymer and the carrier sheet has been lowered to well below the tackifying temperature, preferably at least 30° C. below. Such glossy effects can, of course, be obtained both by transfer to sheet material and to pre-cut parts.

Another effect obtainable is the stabilisation of intrinsically unstable sheet structures. "Unstable" may means that the sheet structure can be easily stretched beyond elastic recovery, that the sheet is unstable if subjected to swelling treatments (e.g. that it will shrink strongly when washed) that the cohesion of the structural components of the sheet material is weak (e.g. an unbonded web of fibres), or that components come off too easily (e.g. non-wovens showing excessive linting tendency).

Knitted fabrics, which can easily be distorted or stretched beyond elastic recovery, or which excessively shrink in direction if stretched lengthwise, can be stabilised to a remarkable degree if polymers are applied in a suitable pattern. Thin lines printed in the direction to be stabilised have been found to be very effective.

If desired, e.g. if stabilisation is required only during processing (e.g. embroidering, printing or other treatments requiring a high degree of accuracy and stability at positioning procedures), the thermoplastic material transferred may be of a soluble type, i.e. it may be a polymer whose intramolecular cohesion can be lowered by treatment with aqueous solutions (containing for example acidic or alkaline or other agents lowering intramolecular cohesion further, and/or dispersing agents facilitating removal from the stabilised sheet material) to a degree sufficient to remove the polymer for instance in washing or dry-cleaning treatments.

Unstable sheet structures such as for instance knitted or non-woven fabrics may also be transfer-treated to increase dimensional stability in washing and dry-cleaning treatments without chemical modification of the substrate (cellulosic sheet material can be dimensionally stabilised by a treatment with crosslinking agents, which is known to lower strength properties and absorbency). Here again a line pattern has been found to be very effective. In such cases one will naturally use a polymer preparation formulated in such a way that the transferred pattern is durable against the treatments for which the fabric is to be rendered stable.

To reduce or remove for instance, the linting, pilling, fuzz-forming or frosting tendency of a textile sheet material (e.g. the linting tendency of a non-woven, the pilling or frosting tendency of a woven or knitted fabric), any pattern in principle is applicable (even all-over transfer coating), but from the point of view of softness, handle, drape, air permeability and absorbancy thin line patterns or narrowly spaced dots or dashes are most suitable.

Transferred polymers may also be used to modify the drape or hand of a sheet structure, in particular textile fabrics, in a predeterminable way. Line patterns will for instance change the drape of a fabric remarkably by imparting draping properties not inherent to the structure per se. This too applies both to the transfer to sheet material and to precut pieces of apparel.

Transferring polymers for instance in a line pattern to sheet material (in particular to precut garment such for example as garment sleeves), the smoothness and gliding properties of a material may be improved to such a degree that no lining is necessary.

In all these applications the intrinsic advantages of the patterned application of polymeric material by transfer over direct printing or other application methods involving pastes, and dispersions (i.e. liquid, not pre-gelled or predried preparations), are indispensible for successful commercial usage. The polymeric material does not penetrate into sheet structures and thus does not excessively stiffen the material, nor does it adversely affect absorbency or other important properties.

Stabilising effects can be achieved even if only surface portions of the sheet material are affected, i.e. without substantial penetration, which would block access to the absorptive material and block yarn to yarn and/or fibre to fibre movement, resulting in a high increase of stiffness. It is well known that such blocking tends to lower resistance to abrasion and tear strength markedly. If on the other hand intrinsically stiff polymeric material is transferred, local stiffening may be achieved, again without substantial loss of absorbency and without substantial blocking of yarn and fibre to fibre movement except locally in very limited surface portions.

If desired the polymeric material preparation may be formulated in such a way (selecting the polymeric material and/or additives), that after transfer differential dyeing effects may be achieved by piece dying techniques.

In many embodiments of the invention, transfer is facilitated and fastness properties of the transferred printing effects are improved, if the preparation contains truly thermoplastic polymeric material in addition to polymers (such as, for instance, crosslinkable acrylates), which are not truly thermoplastic, i.e. which when heated to a certain temperature loss their thermoplasticity at least partly, i.e. which undergo a chemical or physicochemical modification which changes their response to heating.

Transfer may be facilitated if the polymeric material to be transferred is in a slightly swollen state when transfer starts, i.e. if intermolecular cohesion is slightly reduced compared to the level it has in complete absence of swelling agents. In practice, the most economical and efficient way to transfer at a lower level of cohesion is to prevent complete drying of aqueous preparations containing polymeric material at least slightly swellable in water, or to stop the coalescing of dispersions before it is completed, i.e. before any further treatment conductive to coalescing would no longer increase the degree of gelling.

If crosslinkable polymeric material is present in a formulation, it is in most cases desirable (or even necessary if the degree of crosslinking would be realitively high) to prevent crosslinking before transfer has taken place. In many cases crosslinking can be effected with the heat applied during transfer, but it may be desirable (or necessary if crosslinking requires temperatures higher than transfer temperature or curing times longer than transfer time) to subject the printed material to a thermal after treatment.

It has also been found that the method according to the invention may be used for applying polymeric preparations capable serving as adhesives to surfaces, i.e. of agents which when activated by heat, pressure or by swelling agents will produce strong adhesion to two surfaces brought into contact and will produce a strong bond between these two surfaces after the action of the activation agent has ceased. If desired the preparation may be provided with two levels of tackifying temperatures, a lower for transfer and a higher for use as an adhesive.

An important advantage of this method for applying adhesives in particular to porous surfaces is that undesirable penetration of the adhesive can easily be prevented, while this is almost impossible if the same adhesive would be applied in the form of a viscous liquid or a paste. Another advantage, which is particularly important for fast, highly automated operations involving adhesive preparations, lies in the fact that no drying is necessary.

This advantage also applies to the high speed application by transfer of colouring material, stiffening or scaffolding agents applied locally.

The method according to the invention is also very suitable if two or more layers containing agents capable of chemical or physicochemical interaction are to be applied to a surface, where no interaction is desirable during the application nor during storage, but only at a later stage, and where such interaction is for instance promoted by mechanical action causing mixing of the preparations at the interfaces of the layers caused to penetrate each other.

Still another application of the process according to the invention is to incorporate agents into the preparation in encapsulated form, these agents being freed during transfer or subsequently for instance by the action of pressure and/or heat. Encapsulation may be through the formation of a physically discernible skin around the agents, or by forming an interface between ionomeric or ionic compounds of opposite charge, i.e. between an inner phase containing a strongly kationic or anionic agent, and an outer phase containing an agent of the opposite ionic nature.

It also has been found that three dimensional structures may be transferred, stays such as those used in shirt collars being an example.

Following is a description by way of example only of the methods of carrying the invention into effect.

EXAMPLE 1

To a coated release paper, which showed less than 0.2 percent shrinkage when wetted on the coated side and dried at 100° C., the following preparation printing paste was applied by screen printing (all parts by weight):

24 parts SRD 1229 (acrylate containing a blowing agent)
20 parts polyethylene powder (NA 5374)
10 parts latecoll (polyacrylate thickener)
2 parts ammonia (20% solution)
28 parts water
4 parts fatty amid softener (Belsoft 200)
3 parts silicone antifoaming agent
0.1 parts red pigment (Helizarin Brilliant Red BBT).

After printing, the preparation was dried at 100° C.

The peel strength of a strip 5 cm wide and 0.02 cm thick was 110 grams, the tensile strength of the strip (determined after peeling) 170 grams.

Transfer to a white cotton was effected by superimposing the printed side of the release paper on the cotton fabric (both the transfer paper and the fabric had been die-cut into the front section of a girl's dress, and the pressing on a flat bed press at a temperature of 200° C. and a pressure of 1.5 kilos/m2 for 20 seconds.

This heat treatment resulted in the polymer preparation becoming firmly anchored in the surface structure of the fabric (to which it firmly adhered when the release paper was peeled off), and in causing the polymer preparation to turn into a sponge-like structure due to the decomposition of the blowing agent.

EXAMPLE 2

The following preparation was applied by screen printing to release paper:

100 parts crosslinkable polyacrylate (Primal LE 1126)
20 parts SRD 1229
5 parts melamine-formaldehyde precondensate (Kanrit M70)
0.1 part blue pigment
2 parts silicone antifoaming agent
5 parts acrylic copolymer thickening agent (Primal ASE 60)
20 parts methyl cellulose (4% solution)

After printing the material was dried and transferred in a calender press in sheet form to wall paper, resulting in a coloured three-dimensional pattern as in Example 1.

EXAMPLE 3

On a knitted fabric (100% cotton, jersey, 110 g per square meter), which had been scoured, bleached and dyed, but not resin treated, and which when machine washed at 60° C. showed a shrinkage of 12% in one, 5% in the other direction, fine lines (width 0.5 millimeters, distance between lines 1 millimeter) were printed by transfer from transfer paper. The direction of the lines was parallel to the direction showing more shrinkage. The preparation printed on the transfer paper consisted of 50 parts primal LE 1126/crosslinkable polyacrylate (Rohm & Haas, Philadelphia)
2 parts antifoaming agent (Antimousse H)
25 parts polyethylene powder (Microthene FN 510)
5 parts thickener (4% solids) (Methocel F4M)
80 parts polyvinyl acetate dispersion The formation was dried at 100° C. Transfer was effected at 180° C. Washing shrinkage of the knit was reduced from 12% to 4%. The stripes were hardly noticable when the material was made up into a dress, with the stripes on the inside.

Resistance to bagging at the elbows and to distortion in general (stretching beyond elastic recovery) was found to be markedly improved too.

EXAMPLE 4

The same knitted fabric as in Example 3 was printed with a line pattern (width of lines 2 millimeters, distance between lines 2 centimeters). Transfer was from a polyester film, the formulation was the same as in Example 1, except that 0.1 parts of a red pigment (Helizarin Brilliant Red) were added.

After transfer had been effect, the polyester film was peeled off only after it had cooled to 40° C. (transfer temperature 180° C.).

The lines showed high gloss, the drape of the material was markedly changed, the lines controlling the drape in a way resembling a pleating effect.

In an additional test, the printed knit was after treated with a cellulose crosslinking agent (dimethylol-ethylene urea) to improve the dimensional stability (lines spaced as described do usually not sufficiently stabilise a fabric structure).

EXAMPLE 5

A polyester/cotton voile (desized, boiled off, bleached and printed, but not heat set) was treated with the transfer film described in Example 4, the spacing of lines (width one millimeter, arranged in a wave pattern) being two millimeters. The transfer temperature, which was 200° C., caused the polyester fibres to shrink, producing a puckering effect in addition to glossy lines running across the printing design.

EXAMPLE 6

On to a non-woven fabric containing no binder (entangled pulp/polyester fibre composite structure) a grid pattern (width of lines 1 millimeter, distance 2 millimeters, angel 90° C. between the two line systems) was printed by transfer, the formulation being the same as in Example 3.

The non-woven structure was unstable before the treatment in the sense that fibres could be removed very easily and even very little stretching produced irreversible distortion of the structure, the printed material was much more stable. Only few if any fibres cam off on the printed side, and the structure showed elastic recovery to a degree of stretching of more than 10%. Absorbency determined both by wicking tests and by determining the amount of water retained after wetting and spinning in a centrifuge was reduced by less than 5%.

EXAMPLE 7

The treatment described in Example 3 was repeated, transfer being effected from an endless belt made of an aramide fabric (serving as base fabric) laminated to a polyester film. This endless belt was printed with the preparation described in Example 1, which then was gelled and dried to a solids content of 90% before transfer took place at 190° C. in a continuous process between rollers transmitting the heat to the printing pattern and the fabric to be printed.

What is claimed is:

1. A polymeric article adapted for heat and pressure transfer to a substrate, said article comprising a layer of composite polymeric material having temporarily adhered thereto a sheet material adapted to act as a release sheet, said composite polymeric material being adapted to be secured to a substrate on application of heat and pressure sufficient to tackify said material and allow the release sheet to be removed;

wherein components of said composite polymeric material are capable of undergoing an interraction which modifies its chemical structure when a temperature significantly higher than the tackifying temperature is applied in the absense of pressure and after the article has been secured to the substrate and the sheet material removed from the article.

2. An article according to claim 1, wherein the interreaction is such as to increase intermolecular cohesion, and in that the temperature selected is 10 to 100° C. higher than the tackifying temperature.

3. An article according to claim 1 when said composite polymeric material comprises two or more layers which chemically or physiochemically inter-react above the tackifying temperature.

4. An article as claimed in claim 1 wherein the inter-reaction is a blowing reaction and the temperature selected from 10° to 100° C. higher than the tackifying temperature.

5. An article as claimed in claim 1 wherein said composite polymeric material includes a proportion of an acrylate containing a blowing agent, polyethlene powder, a polyacrylate thickener, ammonia, water, a fatty amid softener, a silicone antifoaming agent and a pigment.

6. An article as claimed in claim 1 wherein said composite polymeric material includes 24 parts acrylate containing a blowing agent,
20 parts polyethylene powder,
10 parts polyacrylate thickener,
2 parts 20% solution of ammonia,
28 parts water,
4 parts fatty amid softener,
3 parts silicone antifoaming agent, and
0.10 parts pigment.

7. An article as claimed in claim 1 wherein said composite polymeric material includes:

100 parts cross linkable polyacrylate,
20 parts acrylate containing a blowing agent,
5 parts melamine formaldehyde percondensate,
0.10 part pigment,
2 parts silicone antifoaming agent,
5 parts acrylic copolymer thickening agent,
20 parts methyl cellulose (4% solution).

* * * * *